US005797806A

United States Patent [19]

Butler

[11] Patent Number: 5,797,806

[45] Date of Patent: Aug. 25, 1998

[54] GOLF CLUB HAVING SHOCK ISOLATION BETWEEN THE HEAD AND THE SHAFT

[75] Inventor: Byron Butler, Rancho Santa Margarita, Calif.

[73] Assignee: I.D. Golf, Carlsbad, Calif.

[21] Appl. No.: 815,268

[22] Filed: Mar. 10, 1997

Related U.S. Application Data

[63] Continuation-in-part of Ser. No. 742,737, Nov. 1, 1996.

[51] Int. Cl.[6] ..... A63B 53/02

[52] U.S. Cl. ..... 473/310; 473/345

[58] Field of Search ..... 473/309, 310, 473/311, 345

[56] References Cited

U.S. PATENT DOCUMENTS

| | | | |
|---|---|---|---|
| 1,551,563 | 9/1925 | Heller | 473/310 |
| 1,906,239 | 5/1933 | Reach | 473/310 |
| 3,819,181 | 6/1974 | Mills | 473/311 |
| 5,377,979 | 1/1995 | Long | 473/310 |
| 5,452,890 | 9/1995 | Bingman | 473/310 |
| 5,575,723 | 11/1996 | Take | 473/310 |

*Primary Examiner*—Sebastiano Passaniti
*Assistant Examiner*—Stephen L. Blau
*Attorney, Agent, or Firm*—Leonard Tachner

[57] ABSTRACT

The head and shaft of golf clubs are mechanically isolated from one another by a dampening ferrule made of a rubber-like material and installed around the shaft where the shaft attaches to the head such as at the hosel. The ferrule in a disclosed embodiment is configured as a hollow cylinder having an internal passage for tight-fit engagement with the shaft and an external radial surface for tight-fit engagement with the golf club head. Preferred materials for the dampening ferrule include Neoprene, Delrin, Nylon, plastic polymers and other rubber-like substances.

1 Claim, 3 Drawing Sheets

GOLF CLUB HAVING SHOCK ISOLATION BETWEEN THE HEAD AND THE SHAFT

CROSS-REFERENCE TO RELATED APPLICATIONS

This application is a continuation-in-part of patent application Ser. No. 08/742,737 filed on Nov. 1, 1996.

BACKGROUND OF THE INVENTION

1. FIELD OF THE INVENTION

The present invention relates generally to golf club heads and more specifically to golf club heads having a dampening ferrule for surrounding a golf club shaft where the shaft enters the head.

2. PRIOR ART

Conventional golf clubs typically have heads made of metal and shafts made of metal or graphite. Metal is normally used for making all golf club heads whether they're irons, putters or what are even today still referred to as woods. The interconnection between the shaft and the golf club head is usually facilitated by a hosel which is an elongated tubular-like receptacle implemented as an integral portion of the golf club head and having a long recess for receiving the end of the shaft. Most golf club heads have external hosels, that is, hosels which extend above the top of the head external of the head structure designed for striking a golf ball. The applicant herein has filed an application on a metalwood golf club head wherein the hosel is internal to the head, extending upwardly from the interior surface of the sole of the golf club head.

Irrespective of the shape, size or location of the hosel, the connection of the shaft thereto is either metal-to-metal or graphite-to-metal depending upon the material of which the shaft is made. As a result, when the head strikes a golf ball, the shock induced by impact of the head with the ball, is transmitted through the hosel to the shaft, up through the shaft to the grip and into the golfer's hands. While the grip partially attenuates such shock, it is often inadequate to prevent a substantial portion of the shock from still reaching the hands of the golfer. As a result, the golf shot can be inimically affected by the transmitted shock thereby reducing its accuracy. Furthermore, repeated shock or ball impact can be tiring to the golfer and eventually affect the golfer's performance. There is therefore a need to provide an additional means for dampening the impact effect in order to more fully isolate the shock of ball impact from the golfer's hands.

SUMMARY OF THE INVENTION

The present invention meets the aforementioned need by providing a golf club head having an additional dampening implementation. More specifically, in the present invention, each type of golf club head is designed to accommodate a dampening ferrule configured for receiving and surrounding the shaft at or near the hosel. The inventive ferrule provides a dampening or isolating effect between the shaft and the hosel or between the shaft and the head where the shaft passes into the head to reach an internal hosel. The cylindrical ferrule has a passage with an inner diameter for a close fit around the shaft. The ferrule has an outer diameter for which the hosel or head pass-through aperture is adapted to receive in close fit engagement. The ferrule material and length are selected to provide a desired degree of dampening effect. Generally, the softer the material and the longer the ferrule, the greater is the dampening effect.

OBJECTS OF THE INVENTION

It is therefore a principal object of the present invention to provide a golf club head having a means for dampening the interconnection between the head and a shaft.

It is another object of the invention to provide an improved golf club head configured for receiving a dampening ferrule at the juncture of the club head and a shaft.

It is still another object of the invention to provide a golf club in the form of a metalwood, iron and putter, having a rubber-like material ferrule surrounding the golf club shaft where it is attached to the golf club head to dampen ball impact shock before it reaches the golfer's hands.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF PREFERRED EMBODIMENTS

Figure 1:
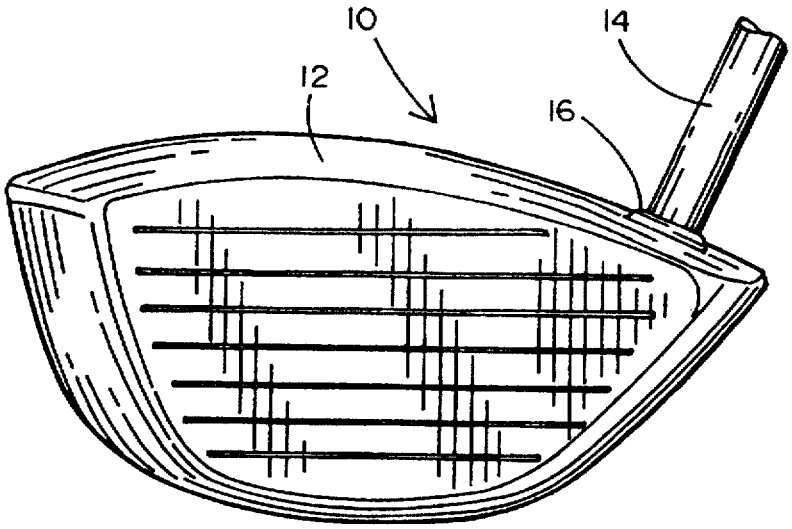
FIG. 1 is an elevational view of a metalwood golf club configured in accordance with the present invention.
Figure 2:
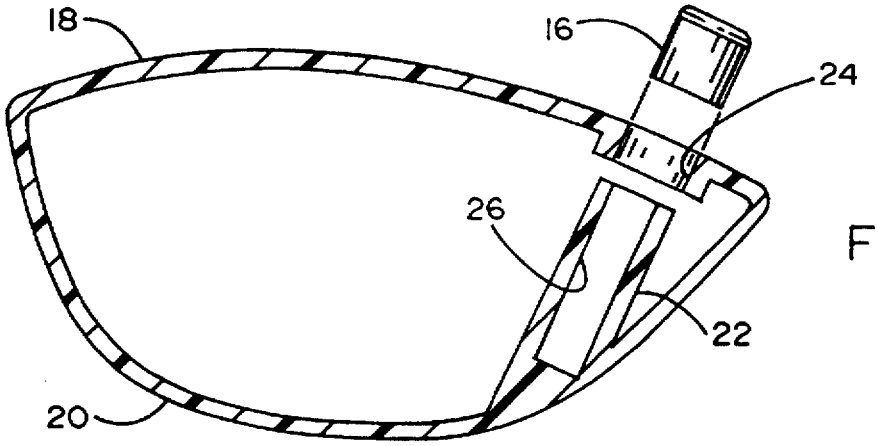
FIG. 2 is a cross-sectional view of the metalwood head of FIG. 1.
Figure 3:
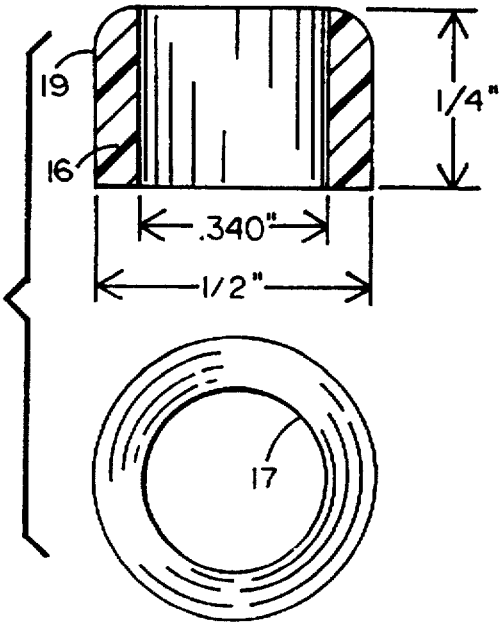
FIG. 3 illustrates the dampening ferrule used in the head of FIG. 1.

Referring to the accompanying figures and FIGS. 1–3 thereof in particular, it will be seen that a metalwood golf club 10 comprises a metalwood head 12 and a shaft 14. Of particular note is a dampening ferrule 16 which surrounds the shaft 14. As seen best in FIG. 2, the dampening ferrule 16 is located in an aperture 24 through the top 18 of the head 12 and extends to an interior hosel 22. Hosel 22 extends upwardly from the interior of a sole 20 and provides a shaft insert 26 for receiving an end of the shaft 14. The ferrule provides a tight-fit engagement with the shaft 14 along its interior passage 17 (as seen in FIG. 3) and with the passage 24 along its exterior surface 19. Ferrule 16 is preferably made of a rubber-like material such as Neoprene, Nylon, Delrin, plastic polymers, or the like, depending upon the degree of shock isolation desired. Normally, the softer the material of which ferrule 16 is made, the greater is the attenuation of ball-strike-induced shock derived from the ferrule. Of course, the shape and dimensions are also significant in that regard. In the preferred embodiment of the invention, ferrule 16 for the metalwood head 12 comprises a hollow right circular cylinder having an outer diameter of ½ inch, and inner diameter of 0.34 inches and a height of ¼ inch. The top of ferrule 16 extends slightly above top 18 of head 12 as shown in FIG. 1 and is preferably rounded or beveled for improved aesthetics.

Figure 4:
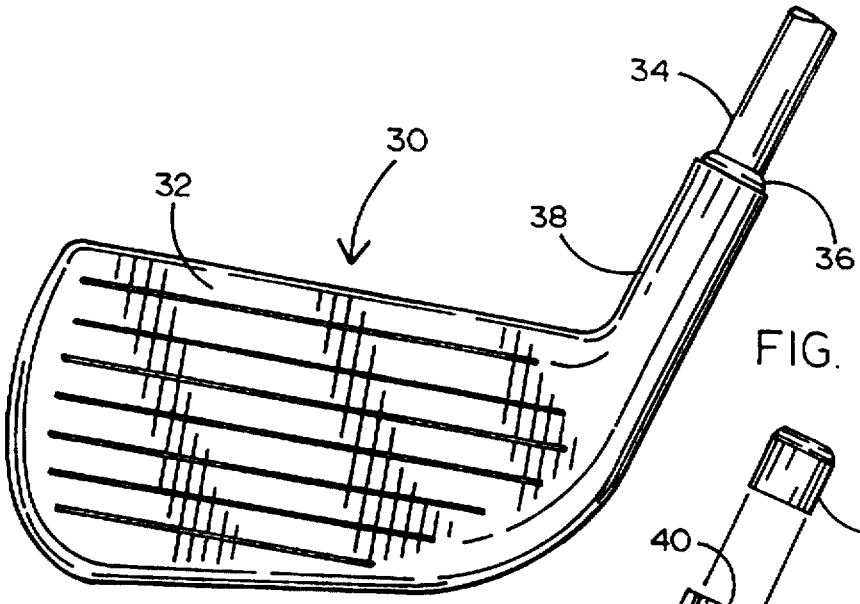
FIG. 4 is an elevational view of an iron golf club configured in accordance with the present invention.
Figure 5:
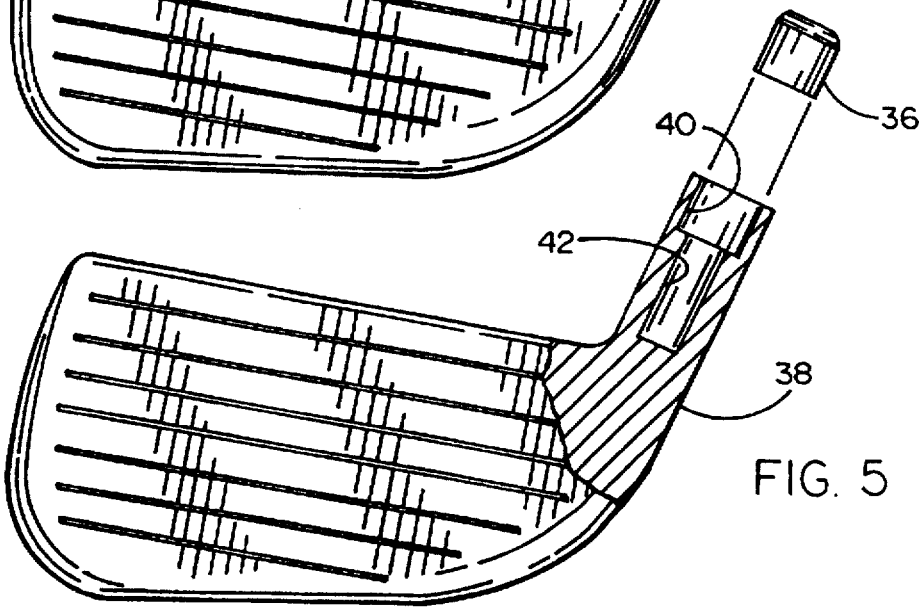
FIG. 5 is a partial cross-sectional view of the iron head of FIG. 4.
Figure 6:
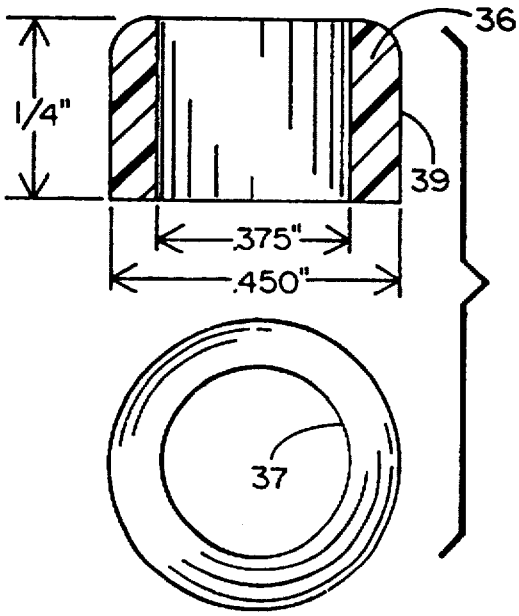
FIG. 6 illustrates the dampening ferrule used in the head of FIG. 4.

An iron-head embodiment of the invention is illustrated in FIGS. 4–6. As shown therein, an iron golf club 30 comprises an iron head 32, a shaft 34 and a dampening ferrule 36. Head 32 provides a hosel 38 for receiving the shaft 34. Inside hosel 38 there are provided a ferrule insert 40 and a shaft insert 42. Ferrule 36 has an interior passage 37 and an exterior surface 39 as seen best in FIG. 6. The diameter of passage 37 is selected to provide a tight-fit engagement with the shaft 34 at the hosel 38. In the illustrated embodiment that diameter is ⅜ inches. The diameter of the exterior surface 39 is selected to provide a tight-fit engagement with insert 40. In the illustrated embodiment that diameter is 0.45 inches. The height of ferrule 36 is ¼ inches in the illustrated embodiment. Insert 42 receives the end of the shaft 34 below the ferrule 36 within hosel 38.

Figure 7:
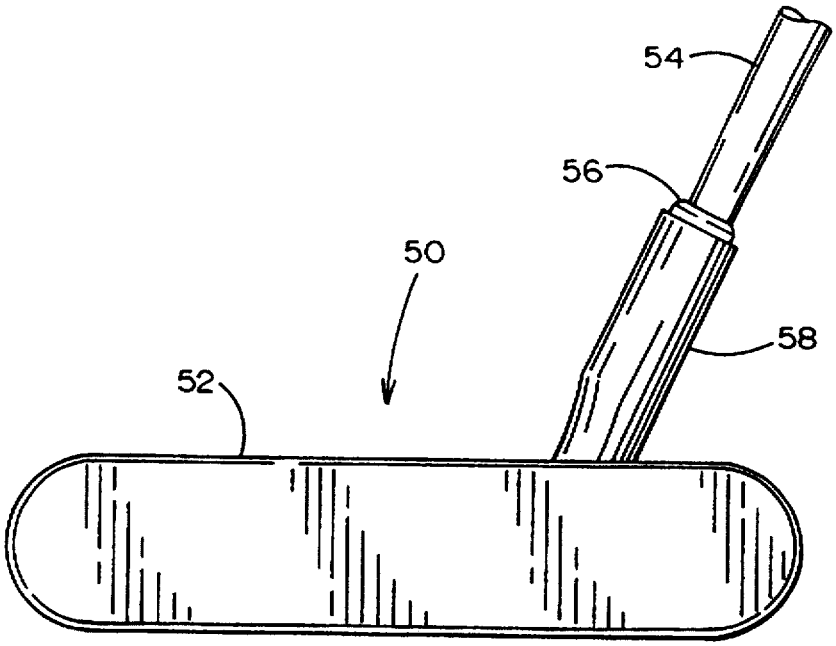
FIG. 7 is an elevational view of a putter golf club configured in accordance with the present invention.
Figure 8:
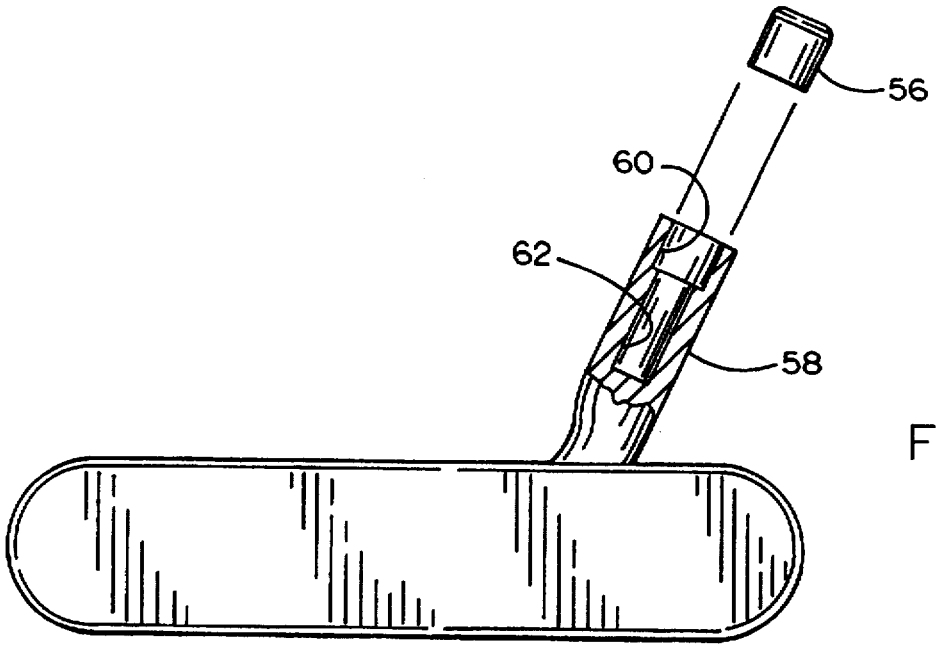
FIG. 8 is a partial cross-sectional view of the putter of FIG. 7.

A putter-head embodiment of the invention is illustrated in FIGS. 7 and 8. A putter head golf club 50 comprises a putter head 52, a shaft 54 and a dampening ferrule 56. Putter head 52 has a hosel 58 which provides a ferrule insert 60 and a shaft insert 62. The ferrule 56 may have the same shape and dimensions as ferrule 36 of FIG. 6. Because the impact of putters with golf balls is normally of much lower intensity, (far slower club head speed at impact), the material selected for ferrule 56 may be dictated more by the desired "feel" at impact as opposed to the desire to isolate the golfer's hands from shock. A softer material such as Neoprene would give the golfer a more attenuated or softer feel, while a harder material such as Nylon or Delrin would provide a less attenuated feel.

Those having skill in the golf club art will now fully comprehend the present invention and its method of manufacture and use. They will also now perceive various modifications which may be made to the invention. By way of example, the specific shape, dimensions and materials associated with the ferrule of the invention may be readily altered to accommodate different golf club heads and to provide different degrees of attenuation between the head and the shaft. Accordingly, it will be understood that the scope of protection afforded hereby is not limited to the exemplary embodiments disclosed herein, but only by the appended claims and their equivalents.

I claim:

1. A golf club comprising:

a metal wood head having an internal hosel and a top line passage, the hosel being spaced from the passage to form a gap therebetween, only the passage and the gap having a shock attenuating ferrule extending therethrough;

a shaft extending through the passage and the gap and extending into the hosel, the ferrule engaging the shaft for dampening vibration of the shaft upon impact of the head with a golf ball, the gap and ferrule permitting limited motion of the shaft relative to the head.

* * * * *